US005211047A

United States Patent [19]

Kaneyuki

[11] Patent Number: 5,211,047

[45] Date of Patent: May 18, 1993

[54] DIE FOR BENDING A COMPOSITE FLANGE HAVING A STRETCH PORTION AND A STRAIGHT PORTION

[75] Inventor: Toshiaki Kaneyuki, Toyota, Japan

[73] Assignee: Toyota Jidosha Kabushiki Kaisha, Toyota, Japan

[21] Appl. No.: 848,048

[22] Filed: Mar. 9, 1992

[30] Foreign Application Priority Data

Mar. 12, 1991 [JP] Japan ..... 3-70405

[51] Int. Cl.[5] ..... B21D 7/00; B21D 53/88

[52] U.S. Cl. ..... 72/313; 72/381; 72/347; 72/379.2

[58] Field of Search ..... 72/312-314, 72/379.2, 412, 380, 381, 386, 358, 347, 351; 29/897.2

[56] References Cited

U.S. PATENT DOCUMENTS 440,051 11/1890 Naylor ..... 72/312
1,881,517 10/1932 Groehn ..... 72/379.2
2,485,649 10/1949 Norquist ..... 72/381
3,263,637 8/1966 Cox ..... 72/347

FOREIGN PATENT DOCUMENTS 59-076625 5/1984 Japan .
33019 2/1987 Japan ..... 72/313

*Primary Examiner*—Daniel C. Crane
*Attorney, Agent, or Firm*—Kenyon & Kenyon

[57] ABSTRACT

A bending die includes a first die portion for bending a stretch portion of a composite flange and a second die portion for bending a straight portion of the composite flange. The first die portion has a first inclined surface inclined at a first angle with respect to a horizontal direction, and the second die portion has a second inclined surface inclined at a second angle with respect to the horizontal direction. The second angle is smaller than the first angle. As a result, when the bending die is moved toward the composite flange, the first inclined surface begins to contact the stretch portion before the second inclined surface contacts the straight portion, so that a warp is prevented from being generated in the composite flange.

6 Claims, 4 Drawing Sheets

DIE FOR BENDING A COMPOSITE FLANGE HAVING A STRETCH PORTION AND A STRAIGHT PORTION

BACKGROUND OF THE INVENTION

1. Field of the Invention

The present invention relates to a die for bending a composite flange having a stretch portion and a straight portion.

2. Description of the Prior Art

An example of a member having a composite flange is a suspension member of an automobile. As illustrated in FIGS. 9 and 10, a suspension member 2 extends longitudinally and is formed by bending a flat plate into a channel member with a substantially inverted U-shaped transverse cross section. Each side of the inverted U constitutes a composite flange 4 which has a stretch portion 6 and a straight portion 8. In this instance, a stretch portion is defined as a flange portion which is bent along a curved bending line 10 and therefore is stretched when bent to generate a tensile stress along the bending line 10 due to a difference between an arc length d2 at the bending line 10 and an arc length d2 along a radially inside edge when the member is in a flat state. A straight portion is defined as a flange portion which is bent along a straight bending line 12 and therefore is not stretched in a longitudinal direction. Due to the tensile stress generated in the stretch portion 6, a warp 14 will be generated in a free edge of the stretch portion 6, as illustrated in FIG. 10.

FIGS. 8*a, b,* and *c* illustrate a conventional method for forming having an inverted U-shaped cross section and a stretch flange portion. In the method, a flat plate is first drawn to form a member with an inverted U-shaped cross section in FIG. 8*a,* then by cam-restriking is compressed into a member 18 with a more exact configuration (FIG. 8*b*), and is finally cam-trimmed to cut off free edge portions 20 of the composite flanges which may be warped, as shown in FIG. 8*c*.

With the prior art method, the various types of cams that are necessary result in increased size and cost of the press machine.

For the purpose of reducing the number of forming cams and dies so as to make the forming machine compact, an alternative forming method as shown in FIGS. 5*a, b,* and *c* has been developed by the inventor. In this method, a flat plate is drawn into a semi-channel member with an intermediate hat-like cross section 22 (FIG. 5*a*), then is press-trimmed at brim portions 24 thereof (FIG. 5*b*), and then is finally bent by bending dies into a full channel member with an inverted U-shaped cross section 26 (FIG. 5*c*). However, in this method, it is necessary to develop a bending die capable of preventing a composite flange from warping during forming from the intermediate hat-like cross section to the final inverted U-shaped cross section. More particularly, if the composite flange were bent using a conventional die 28 as shown in FIG. 7, the stretch portion 30 and the straight portion 32 of the composite flange, as shown in FIG. 6, would begin to be bent at the same time. In this instance, the straight portion 32 would be bent more than the stretch portion 30, because bending of the stretch portion 30 would be suppressed due to the longitudinal tensile stress generated in the stretch portion 30. As a result, a warp 34 would occur at the free edge of the stretch portion 30.

SUMMARY OF THE INVENTION

An object of the invention is to provide a bending die for forming a semi-channel member with a hat-like cross section into a full channel member with an inverted U-shaped cross section, without causing a warp in a composite flange.

In accordance with the present invention, the above-described object can be attained by a bending die for forming an elongated semi-channel member with a hat-like transverse cross section into a full channel member having a substantially inverted U-shaped transverse cross section by bending a brim of the hat-like cross section, the brim comprising a composite flange which extends in a longitudinal direction of the semi-channel member and includes a stretch portion to be bent along a curved bending line and a straight portion, connected to each longitudinal end of the stretch portion, to be bent along a straight bending line.

The bending die includes a first die portion for bending the stretch portion of the composite flange along the curved bending line, the first die portion including a first vertical surface, a first inclined surface, and a first connecting portion defined between the first vertical surface and the first inclined surface, the first vertical surface and the first connecting portion being curved in a longitudinal direction of the bending die, and the first inclined surface being inclined at a first angle with respect to a horizontal direction. The bending die further includes a second die portion for bending the straight portion of the composite flange along the straight bending line, the second die portion including a second vertical surface, a second inclined surface, and a second connecting portion defined between the second vertical surface and the second inclined surface, the second vertical surface extending straight in the vertical direction and in the longitudinal direction of the bending die and being an extension of the first vertical surface of the first die portion in the longitudinal direction of the bending die, and the second inclined surface being inclined at a second angle with respect to the horizontal direction, the second connecting portion being a straight extension in the longitudinal direction of the first connecting portion of the first die portion, the second angle being smaller than the first angle so that the first inclined surface of the first die portion begins to contact the stretch portion before the second inclined surface of the second die portion contacts the straight portion when the bending die is moved vertically toward the brim of the semi-channel member.

When the composite flange is bent using the bending die in accordance with the present invention, the bending die begins to contact and press the stretch portion of the composite flange before the bending die contacts the straight portion of the composite flange, so that the stretch portion and the straight portion will be bent at the same speed from the horizontal position to the vertical position. As a result, no step will occur in the composite flange between the stretch portion and the straight portion in the longitudinal direction of the composite flange, and no warp will be generated in the stretch portion.

BRIEF DESCRIPTION OF THE PREFERRED EMBODIMENTS

The above and other objects, features, and advantages of the present invention will become more apparent and will be more readily appreciated from the following detailed description of the preferred embodiments of the invention taken in conjunction with the accompanying drawings, in which.

Figure 5A:
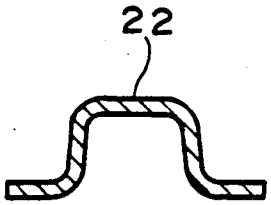
Figure 5B:
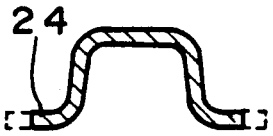
Figure 5C:
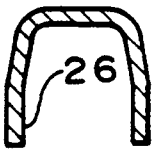
Figure 6:
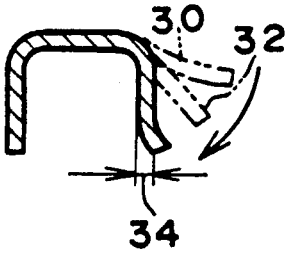
FIG. 6 (PRIOR ART)
Figure 7:
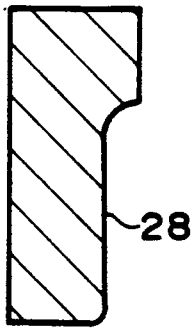
FIG. 7 (PRIOR ART)
Figure 8A:
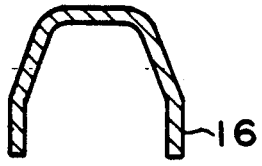
FIG. 8a (PRIOR ART)
Figure 8B:
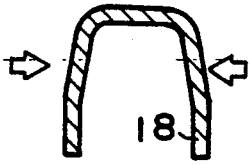
FIG. 8b (PRIOR ART)
Figure 8C:
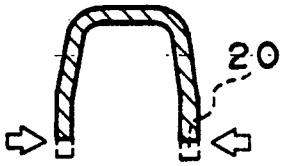
FIG. 8c (PRIOR ART)
Figure 9:
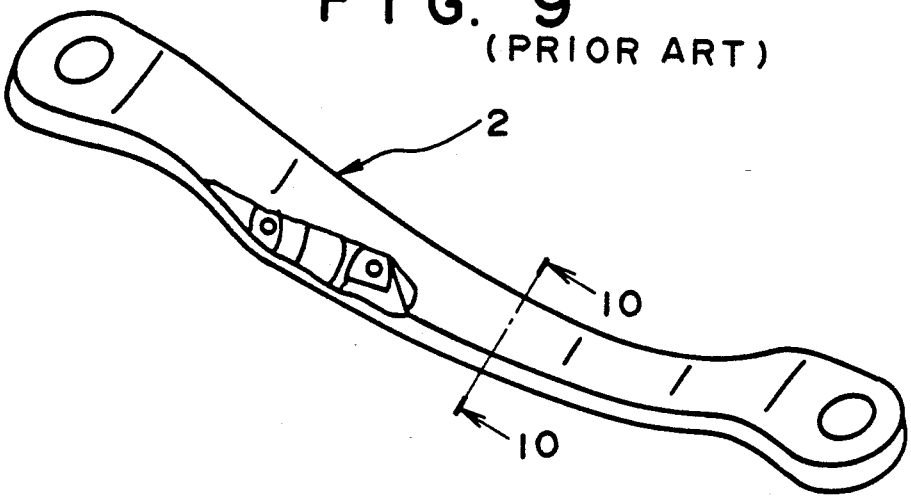
FIG. 9 (PRIOR ART)
Figure 10:
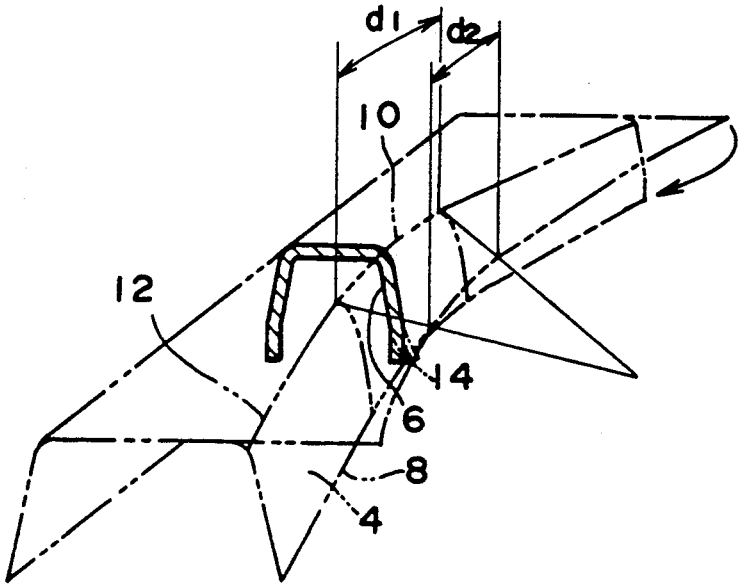
FIG. 10 (PRIOR ART)

FIGS. 5*a*, 5*b* and 5*c* are diagrams illustrating how a semi-channel member with a hat-like cross section is formed into a full channel member with an inverted U-shaped cross section in accordance with the present invention;

FIG. 6 is a cross-sectional view of a channel member bent using a conventional bending die;

FIG. 7 is a cross-sectional view of the conventional bending die used to bend the channel member of FIG. 6;

FIGS. 8*a*, 8*b* and 8*c* are diagrams illustrating how a channel member is formed with an inverted U-shaped cross section in accordance with the prior art method;

FIG. 9 is an oblique view of an automobile suspension channel member having an inverted U-shaped cross section; and FIG. 10 is a cross-sectional view of the member of FIG. 9 taken along line 10—10.

DETAILED DESCRIPTION OF THE PREFERRED EMBODIMENT

As illustrated in FIGS. 5*a*, *b*, and *c*, a full channel member is formed by drawing a flat plate into a semi-channel member 22 having a hat-like transverse cross section as shown in FIG. 5*a*. Then, edges of brims 24 of the panel 22 with a hat-like cross section are trimmed by press, as indicated in FIG. 5*b*. The thus trimmed member with a hat-like transverse cross-section is then formed into a full channel member 26 having an inverted U-shaped cross section by bending the brim using a bending apparatus 50 which includes a bending die 70 according to the present invention.

Figure 3:
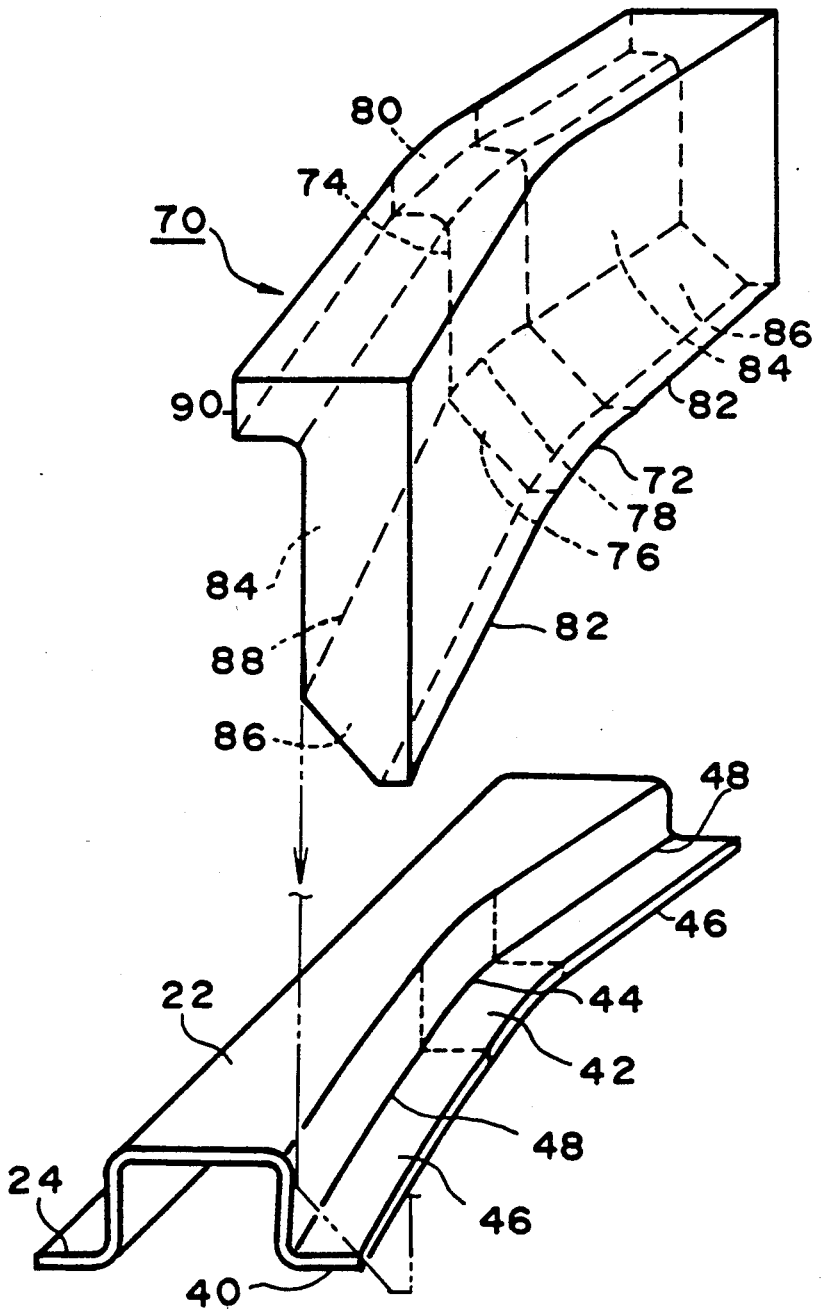
FIG. 3 is an oblique view of the bending die of FIG. 2 in position above a semi-channel member with a hat-like cross section.

As illustrated in FIG. 3, the brim 24 includes a composite flange 40 which extends in a longitudinal direction of the semi-channel member 22 and includes a stretch portion 42 to be bent along a curved bending line 44 and straight portions 46 to be bent along straight bending lines 48. The straight portions 46 are longitudinal extensions from each end of the stretch portion 42.

Figure 1:
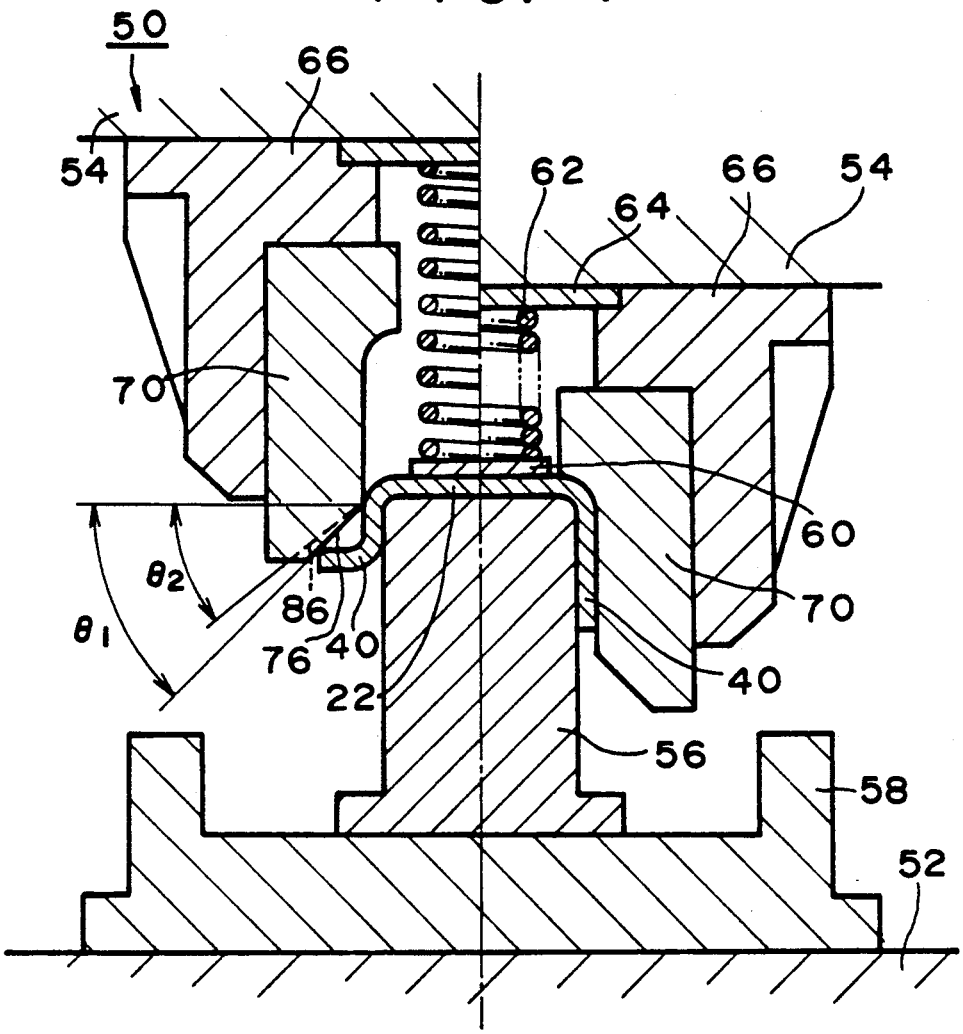
FIG. 1 is a cross-sectional view of a bending apparatus including a bending die in according to an embodiment of the present invention.

As illustrated in FIG. 1, a bending apparatus 50 is mounted in a press apparatus between a base 52 and a ram 54, which is moved in a vertical direction relative to the base 52. The bending apparatus 50 includes a punch 56 for supporting and positioning the semi-channel member 22, a pad 60 located above the punch 56 and biased toward the punch 56 to hold the semi-channel member 22 between the punch 56 and the pad 60, a spring 62 located above the pad 60 and biasing the pad 60 toward the punch 56, a spacer 64 located above the spring 62 and adjusting biasing strength of the spring 62, a punch holder 58 located beneath the punch 56 supports the punch 56, and a die holder 66 carries the bending die 70. The punch holder 58 is fixedly coupled to the base 52 of the press apparatus, and the die holder 66 is fixedly coupled to the ram 54 of the press apparatus. Thus, when the ram 54 is moved vertically relative to the base 52, the bending die 70 is moved vertically relative to the semi-channel member 22 supported on the punch 56 so that each composite flange 40 of the member 22 is bent downward.

Figure 2:
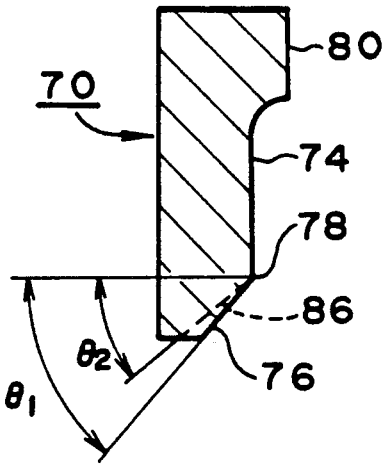
FIG. 2 is a cross-sectional view of the bending die of the bending apparatus of FIG. 1.

As illustrated in FIGS. 2 and 3, the bending die 70 extends longitudinally in a horizontal direction and includes a first die portion 72 for bending the stretch portion 42 of the composite flange 40 along the curved bending line 44 and two second die portions 82 for bending the straight portions 46 along the straight bending lines 48.

The first die portion 72 includes a first vertical surface 74, extending in the vertical direction and curved in the longitudinal direction of the bending die 70, and a first inclined surface 76 inclined at a first angle $\theta_1$ with respect to the horizontal direction. The first vertical surface 74 and the first inclined surface 76 between them define a first connecting portion 78 which is curved in the longitudinal direction of the bending die 78. The first connecting portion 78 may be either sharp-edged or rounded in a transverse direction of the bending die 70. The first inclined surface 76 has a transverse (horizontal) projection larger than the transverse dimension of the stretch portion 42 so that the bending die 70 begins to contact the stretch portion 42 at the inclined surface 76 when the bending die 70 is lowered. The first die portion 72 has a shoulder portion 80 extending laterally inward above the punch 56 so that the shoulder portion 80 presses an upper portion of the semi-channel member 22 above the stretch portion 42 at the final stage of the lowering stroke of the bending die 70.

Each second die portion 82 includes a second vertical surface 84 and a second inclined surface 86. The second vertical surface 84 constitutes a straight extension from a corresponding end of the first vertical surface 74 of the first die portion 72 in the longitudinal direction of the bending die 70. The second inclined surface 86 is inclined at a second angle 82 with respect to the horizontal direction and is connected to the first inclined surface 76 of the first die portion 72. The second inclined surface 86 also has a transverse (horizontal) projection larger than the transverse dimension of the corresponding straight portion 46 so that each second die portion 82 is brought into contact with the respective straight portion 46 at the second inclined surface 86 when the bending die 70 is lowered. The second vertical surface 84 and the second inclined surface 86 between them define a second connecting portion 88 which is straight in the longitudinal direction of the bending die 70. The second die portion 82 also has a shoulder portion 90 extending inwardly above the punch 56 so that the shoulder portion 90 presses an upper portion of the member 22 above the straight portion 46 at the final stage of the lowering stroke of the bending die 70.

Each second connecting portion 80 is an extension of the first connecting portion 78 of the fist die portion 72 at the same level. The second angle $\theta_2$ is smaller than the first angle $\theta_1$ so that the first inclined surface 76 of the first die portion 72 begins to contact the stretch portion 42 of the composite flange 40 of the semi-channel member 22 before the second inclined surface 86 of the second die portion 82 contacts the straight portion 46 of the composite flange 40 of the semi-channel member 22 when the bending die 70 is moved toward the member 22.

The second angle $\theta_2$ is two to four degrees smaller than the first angle $\theta_1$. If the angular difference between the first inclined surface 76 and the second inclined surface 86 is smaller than two degrees, an outward warp would occur after the U-shaped cross section of the full channel member 24 was formed. In contrast, if the angular difference between the first inclined surface 76 and the second inclined surface 86 is larger than four degrees, an inward warp would occur after the U-shaped cross section of the full channel member 24 was formed. The angular difference between the first inclined surface 76 and the second inclined surface 86 is preferably substantially three degrees. For example, the first angle $\theta_1$ is 48° and the second angle $\theta_2$ is 45°.

Operation of the bending die and the bending apparatus in accordance with the present invention will now be explained.

The semi-channel member 22 with a hat-like cross section is mounted and positioned on the punch 56. When the ram 54 is lowered, the pad 60 is first brought into contact with the semi-channel member 22 and holds the top portion of the member 22 on the punch 56 by the biasing force of the spring 62.

When the ram 54 is further lowered, together with the die holder 66 and the bending die 70 held by the die holder 66, the first inclined surface 76 of the first die portion 72 of the bending die 70 begins to contact the stretch portion 42 of the composite flange 40, and then the second inclined surface 86 of the second die portion 82 of the bending die 70 contacts the straight portion 46 of the composite flange 40. The first inclined surface 76 contacts the stretch portion 42 first at an outer free edge of the stretch portion 42 and then at a transversely central portion of the stretch portion 42 to bend down the stretch portion 42 while generating a longitudinally directed tensile stress in the stretch portion 42. The second inclined surface 86 contacts an outer free edge of each straight portion 46 to bend down the straight portion about the straight bending line 48 without generating a longitudinally directed tensile stress except for the tensile stress from the stretch portion 42.

Because the stretch portion 42 begins to be bent down before the straight portion 46 and because the outer free edge of the stretch portion 42 is contacted first and then a transversely central portion, the stretch portion 42 can be bent at the same bending speed as that of the straight portion 46. As a result, no step-like deformation is generated in a transition portion from the stretch portion 42 to the straight portion 46, and little warp occurs in the transition portion and the stretch portion 42.

Figure 4:
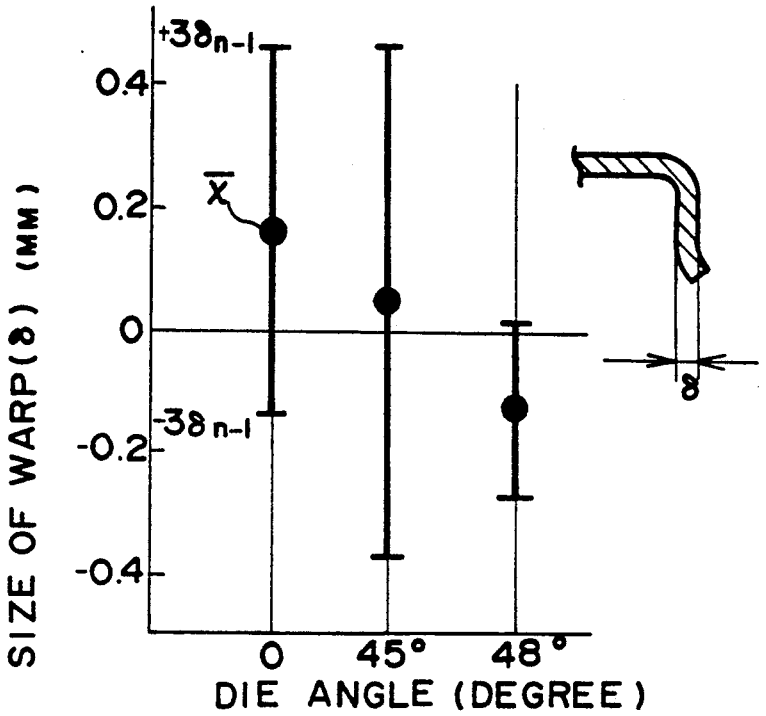
FIG. 4 is a chart illustrating a relationship between a warp amount and an angle of an inclined surface of the bending die of FIG. 2.

Forming tests were conducted using various types of bending dies, and the test results are shown in FIG. 4. In FIG. 4, a die having die angle 0° corresponds to a bending die having no inclined surface as shown in FIG. 7, and a die having die angle 45° is a bending die having the first and second die angles each equal to 45°. A die having die angle 48° is a bending die having the first angle equal to 48° and the second angle equal to 45°, that is, the bending die according to the present invention. As illustrated in FIG. 4, the average value and the standard deviation of warps in the case of the die angle 48° are much smaller than those of the cases of the die angle 0° and the die angle 45°. This means that substantially no warp is generated in the full channel member 24 with an inverted U-shaped cross section formed using the bending die 70 in accordance with the present invention and that the forming method according to FIG. 5 can be adopted.

In accordance with the present invention, the following advantages are obtained.

First, a channel member can be formed from a hat-like cross section to an inverted U-shaped cross section by a simple bending die structure which is much simpler than the prior art multi-cam structure.

Second, a bending die is provided with only a first inclined surface and a second inclined surface, such change in bending die structure will not be accompanied by an increase in cost.

Third, since the die begins to press down a stretch portion before a straight portion, and further since the die contacts the free edge of the stretch portion first, a warp generation in a composite flange is effectively prevented.

Although only a single embodiment of the invention has been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A bending die for forming an elongated open-ended semi-channel member with a hat-like transverse cross section into a full channel member with a substantially inverted U-shaped transverse cross section by bending a brim of the semi-channel member with a hat-like cross section, the brim comprising a composite flange which extends in a longitudinal direction of the semi-channel member and includes a stretch portion to be bent along a curved bending line and straight portions, connected to each longitudinal end of the stretch portion, to be bent along a straight bending line, the bending die comprising:

a first die portion for bending the stretch portion of the composite flange along the curved bending line, the first die portion including a first vertical surface, a first inclined surface, and a first connecting portion defined between the first vertical surface and the first inclined surface, each of the first vertical surface, the first inclined surface and the first connecting portion extending in the longitudinal direction and being substantially smoothly curved in the longitudinal direction of the bending die, and the first inclined surface being inclined at a first angle with respect to a horizontal direction, said first inclined surface being defined by a straight line in vertical cross-section; and second die portions for bending the straight portions of the composite flange along the straight bending line, each second die portion including a second vertical surface, a second substantially flat inclined surface, and a second connecting portion defined between the second vertical surface and the second inclined surface, the second vertical surface extending straight in the vertical direction and in the longitudinal direction of the bending die and constituting an extension of the first vertical surface of the first die portion in the longitudinal direction of the bending die, and the second inclined surface being connected substantially smoothly to the first inclined surface in the longitudinal direction of the bending die and being inclined at a second angle with respect to the horizontal direction, the second connecting portion being a straight extension in the longitudinal direction of the first connecting portion of the first die portion, the second angle being smaller than the first angle so that the first inclined surface of the first die portion begins to contact the stretch portion before the second inclined surface of the second die portion contacts the straight portion when the bending die is moved vertically toward the brim of the semi-channel member.

2. A bending die according to claim 1, wherein the second angle is two to four degrees smaller than the first angle.

3. A bending die according to claim 1, wherein the second angle is substantially three degrees smaller than the first angle.

4. A bending apparatus for forming an elongated, open-ended semi-channel member with a hat-like transverse cross section into a full channel member with a substantially U-shaped transverse cross section by bending a brim of the semi-channel member with a hat-like cross section, the brim comprising a composite flange which extends in a longitudinal direction of the semi-channel member and includes a stretch portion to be bent along a curved bending line and straight portions, connected to each longitudinal end of the stretch portion, to be bent along a straight bending line, the bending press apparatus comprising:

a punch for supporting and positioning the semi-channel member;

a pad located above the punch and biased toward the punch to hold the panel between the punch and the pad when the pad is moved toward the punch;

a spring located above the pad and biasing the pad toward the punch;

a punch holder located beneath the punch and fixedly supporting the punch thereon;

a bending die relatively and vertically movable with respect to the punch; and a die holder vertically movable and supporting and wherein the bending die comprises:

a first die portion for bending the stretch portion of the composite flange along the curved bending line, the first die portion including a first vertical surface, a first inclined surface, and a first connecting portion defined between the first vertical surface and the first inclined surface, each of the first vertical surface, the first inclined surface and the first connecting portion extending in the longitudinal direction and being substantially smoothly curved in the longitudinal direction of the bending die, and the first inclined surface being inclined at a first angle with respect to a horizontal direction, said first inclined surface being defined by a straight line in vertical cross-section; and second die portions for bending the straight portions of the composite flange along the straight bending line, each second die portion including a second vertical surface, a second substantially flat inclined surface, and a second connecting portion defined between the second vertical surface and the second inclined surface, the second vertical surface extending straight in the vertical direction and in the longitudinal direction of the bending die and constituting an extension of the first vertical surface of the first die portion in the longitudinal direction of the bending die, and the second inclined surface being connected substantially smoothly to the first inclined surface in the longitudinal direction of the bending die and being inclined at a second angle with respect to the horizontal direction, the second connecting portion being a straight extension in the longitudinal direction of the first connecting portion of the first die portion, the second angle being smaller than the first angle so that the first inclined surface of the first die portion begins to contact the stretch portion before the second inclined surface of the second die portion contacts the straight portion when the bending die is moved vertically toward the brim of the semi-channel member.

5. A bending apparatus according to claim 4, wherein the second angle is two to four degrees smaller than the first angle.

6. A bending apparatus according to claim 4, wherein the second angle is substantially three degrees smaller than the first angle.

* * * * *